US006341720B1

(12) United States Patent
Schmit et al.

(10) Patent No.: US 6,341,720 B1
(45) Date of Patent: Jan. 29, 2002

(54) TRI-CLOSURE DISPENSING TOP

(75) Inventors: Michael Robert Schmit, Deephaven, MN (US); James F. Kick, Chesterfield, MO (US); J. Mark Morrow, Camden, SC (US)

(73) Assignee: Sonoco Products Company, Hartsville, SC (US)

( * ) Notice: Subject to any disclaimer, the term of this patent is extended or adjusted under 35 U.S.C. 154(b) by 0 days.

(21) Appl. No.: 09/726,330

(22) Filed: Dec. 1, 2000

(51) Int. Cl.[7] ..... B67D 3/00
(52) U.S. Cl. ..... 222/480
(58) Field of Search ..... 222/480, 482, 222/556

(56) References Cited

U.S. PATENT DOCUMENTS

| | | | | | |
|---|---|---|---|---|---|
| 2,544,524 | A | * | 3/1951 | Bonneyfoy | 222/480 |
| 3,018,931 | A | | 1/1962 | Westgate | 222/480 |
| 3,057,525 | A | | 10/1962 | Malachick | 222/482 |
| 3,140,019 | A | | 7/1964 | Barr | 222/480 |
| 4,106,672 | A | | 8/1978 | Tecco et al. | 222/151 |
| 4,541,541 | A | | 9/1985 | Hichman et al. | 220/253 |
| 4,658,980 | A | | 4/1987 | Lindstrom | 220/214 |
| 4,693,399 | A | | 9/1987 | Hickman et al. | 220/339 |
| 4,714,181 | A | | 12/1987 | Kozlowski et al. | 222/480 |
| 4,792,054 | A | | 12/1988 | Weidman | 222/23 |
| 4,936,494 | A | | 6/1990 | Weidman | 222/480 |
| 5,330,082 | A | | 7/1994 | Forsyth | 222/480 |
| 5,339,993 | A | | 8/1994 | Groya et al. | 222/153 |
| 5,407,107 | A | | 4/1995 | Smith | 222/548 |
| 5,507,419 | A | | 4/1996 | Martin et al. | 480/222 |
| 5,601,213 | A | | 2/1997 | Daniello | 222/456 |
| 5,697,533 | A | | 12/1997 | Shahbazian | 222/480 |
| 5,706,981 | A | | 1/1998 | Nobakht | 222/132 |
| 5,799,838 | A | | 9/1998 | Miller | 222/480 |
| 5,897,036 | A | | 4/1999 | DeCoster et al. | 222/480 |

FOREIGN PATENT DOCUMENTS

| | | |
|---|---|---|
| GB | 2 135 981 A | 9/1984 |

* cited by examiner

*Primary Examiner*—Philippe Derakshani
*Assistant Examiner*—Thach H. Bui
(74) *Attorney, Agent, or Firm*—Banner & Witcoff, Ltd.

(57) ABSTRACT

A one-piece dispensing top has three separate dispensing ports. Each dispensing port is designed to dispense particulate foodstuffs from a container. One port is configured to allow removal of product with an utensil. A second port is configured to be used for pouring product and includes a spout, and a third port is configured for sifting product. Each dispensing port includes a closure flap for sealing. All three closure flaps are integrally joined to the dispensing top via living hinges. The closure flaps may be retained in the closed position by a friction or snap fit.

20 Claims, 4 Drawing Sheets

TRI-CLOSURE DISPENSING TOP

FIELD OF THE INVENTION

This invention relates to a dispensing top for a container holding particulate material such as spices and other foodstuffs. More particularly, this invention relates to a dispensing top formed of a single piece of thermoplastic and having dispensing ports for pouring, sifting and spooning functions.

BACKGROUND OF THE INVENTION

For many years, suppliers of food product have sought to provide consumers with convenient and simple to use packaging. The packaging protects and stores the product, and also helps to sell the product to consumers. Particulate or granular food product, such as spices, salt, and sugar are packaged in various containers. In seeking to help consumers, manufacturers have developed packaging systems that have a container with a dispensing top. Some dispensing tops have movable closures that cover openings in the tops. Most of these tops are fitted with one or more dispensing ports for pouring, sifting or spooning food product. Few dispensing tops provide all three dispensing options.

Examples of dispensing tops having three dispensing ports include U.S. Pat. No. 5,407,107 to Smith, U.S. Pat. No. 5,706,981 to Nobakht, and U.K. Patent Application No. GB 2,135,981A by Swett et al. However, none of the foregoing has a pouring spout to guide the flow of product, none are formed of a single piece of material, and none have living hinges. U.S. Pat. No. 4,658,980 to Lindstrom discloses a three closure top. There is, however, no pouring spout and no living hinges are used. All United States patents referred herein shall be deemed incorporated by reference for all purposes as to their entire contents.

Smith discloses a rotary type closure having two-piece a rotatable selector cap mounted over a sealing disk. The sealing disk has openings for three different dispensing modes: pour, sift or spoon, while the selector cap has a single opening. The dispensing mode is determined by rotating the selector cap with respect to the sealing disk to expose the desired dispensing opening. The pour opening does not have a pivotally positionable spout to control the flow of product.

Nobakht and Swett et al. disclose a separable two-piece flap type closure top having a cover and a sealing member attached to the cover in fixed relationship thereto. The cover has three dispensing ports and the sealing member has three closure flaps corresponding to each port. None of the dispensing ports has a pouring spout or living hinges.

Rotary type closures have a rotatable rotor mounted over a base. The base has one or more openings through which product can be dispensed. The rotor has one or more openings that are registrable with the openings in the base when the rotor is rotated. Because the rotor openings do not have closure flaps, the container is closed by rotating the rotor until the rotor openings are out of alignment with the base openings. Thus, the rotor must have at least one area in which the web does not have any openings and, therefore, can block the openings in the base.

Thus, there exists a need for an easy-to-manufacture, one piece dispensing top having three dispensing ports for pouring, sifting and spooning product; and a spout integrally formed with the top. The present invention fulfills this need, and thus enables a manufacturer to reduce costs and provide users with multiple dispensing options.

SUMMARY OF THE INVENTION

In an exemplary embodiment, a one-piece single web dispensing top includes three separate dispensing ports.

Each port is designed to dispense particulate material, such as spices, condiments and other food products. One port is configured to allow removal of product with a utensil such as a spoon, one port is configured to be used for pouring product and includes a spout, and a third port is configured for sifting product. The dispensing top is attached to a container, preferably with glue, although other attachment methods may be used, such as a threaded engagement means or a snap-fit method. Each dispensing port includes a closure flap for sealing. All three closure flaps are integrally joined to a raised planar surface of the dispensing top by living hinges. The closure flaps may be retained in the closed position by a friction or snap fit.

The present invention advantageously provides for larger dispensing openings than can be realized with conventional rotary type closures. The present invention, by contrast, uses closure flaps to close the container. In addition, the present invention advantageously requires less material than rotary type closures because the present invention requires only one thermoplastic web, not two webs. Yet another advantage of the present invention provides a three-mode dispenser that maximizes the size of the dispensing openings.

Thus, it is an object of the present invention to combine the three primary dispensing options: pour, sift and spoon, into a single piece dispensing top.

A further object of the present invention is to provide a dispensing container that can be used with a variety of containers and a variety of particulate or granular products.

Another object of the present invention is to provide a multiple function dispensing top in which each dispensing opening has its own cover.

These and other objects, features and advantages of the present invention will be apparent upon consideration of the following detailed description thereof, presented in connection with the following drawings in which like reference numerals identifying the elements throughout.

DETAILED DESCRIPTION OF THE PREFERRED EMBODIMENT

Figure 1:
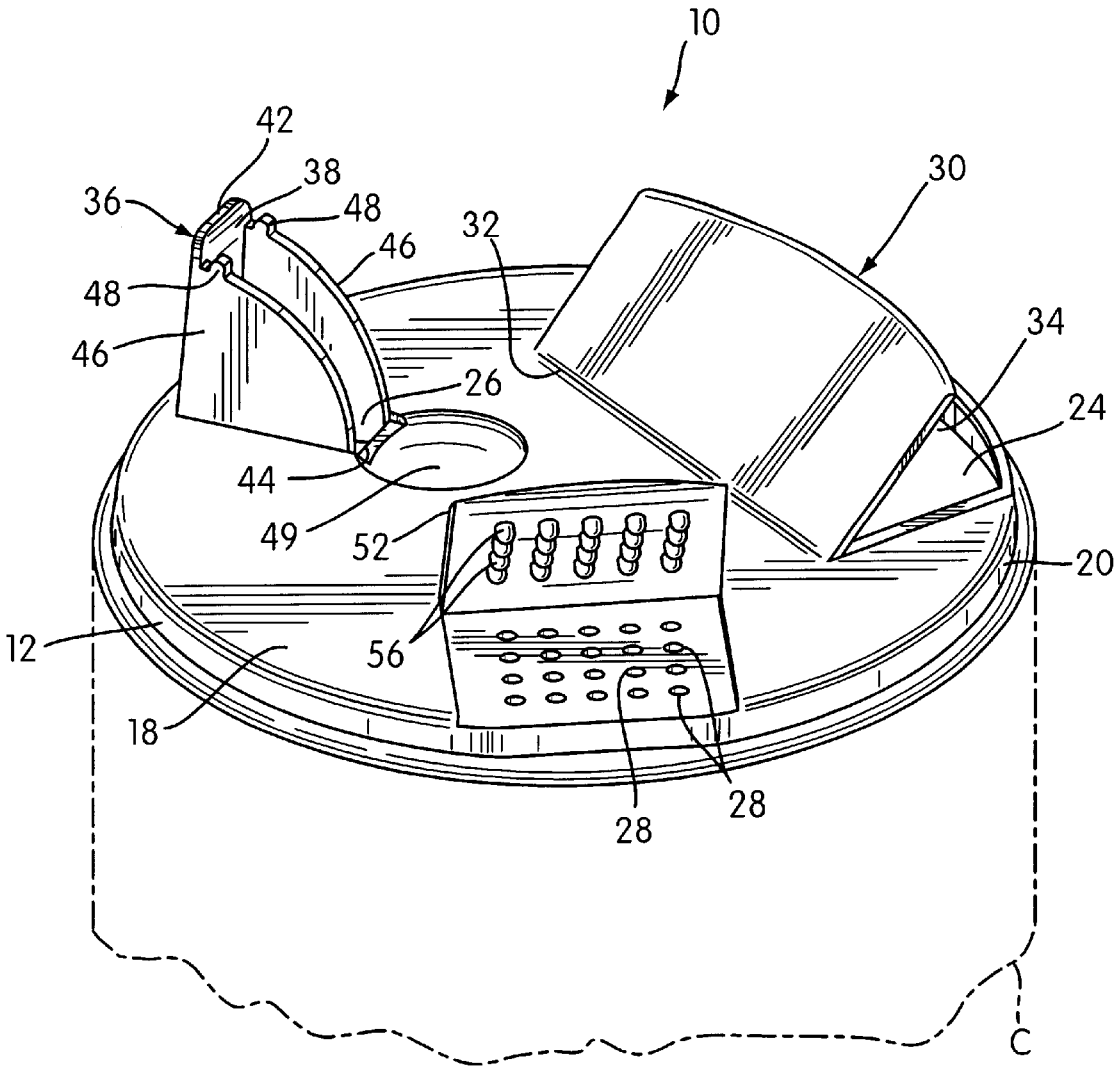
FIG. 1 is a perspective view of a tri-closure dispensing top of the present invention showing all three closure flaps in the open position.
Figure 2:
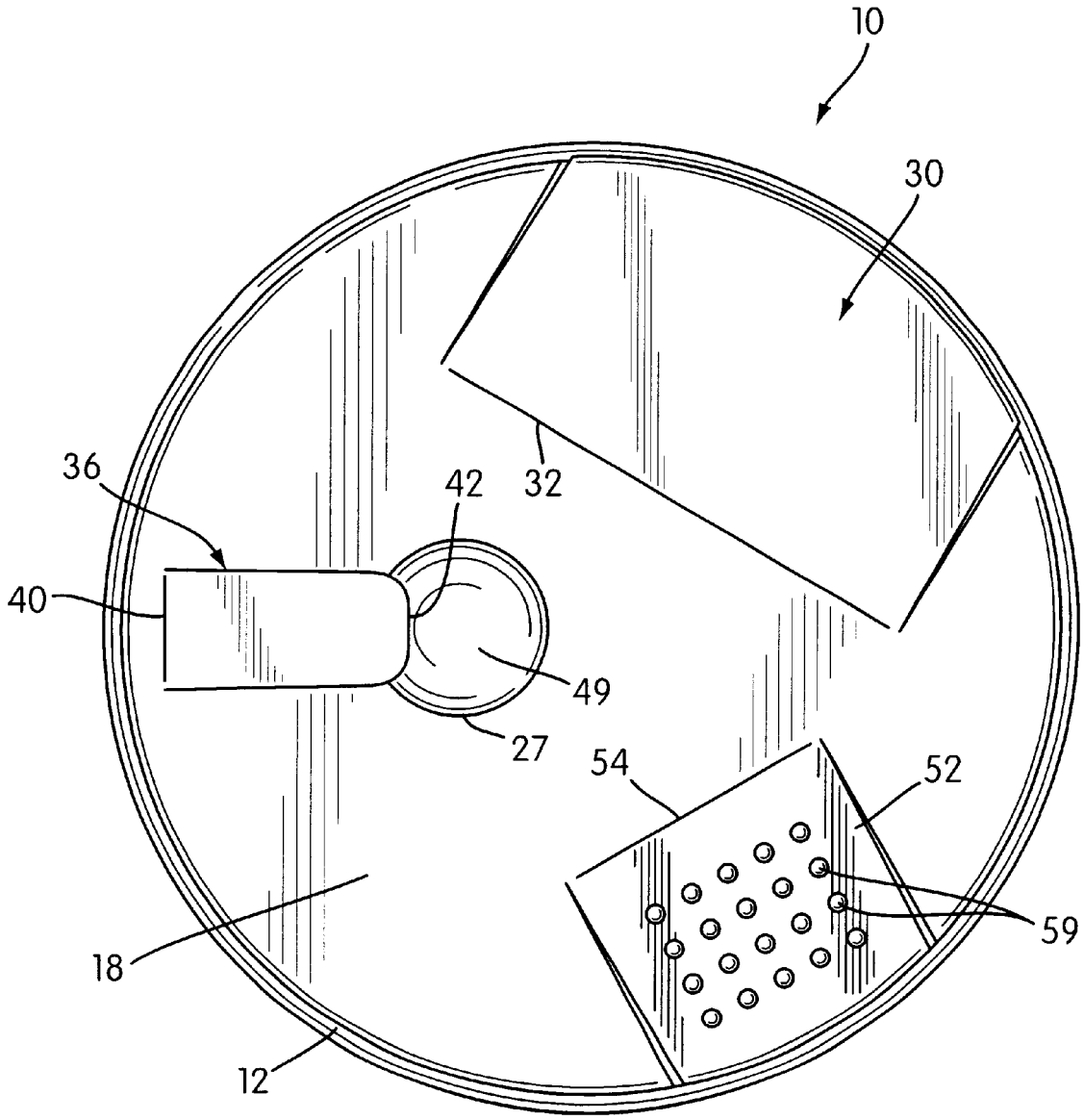
FIG. 2 is a top plan view of the tri-closure dispensing top of FIG. 1.

FIGS. 1-4 illustrates a first embodiment of the present invention, a tri-closure dispensing top 10 for dispensing particulate material, such as spices, condiments and other food products. Dispensing top 10 is single molded assembly and is adapted for attachment to a container C either by glue, mated threads, or interference fit or other attachment methods.

Dispensing top 10 comprises three distinct dispensing ports—a spoon port, a pour port, and a sift port each of which will be described herein. The spoon port includes a large single opening 24 for dispensing product from the container with a spoon or similar utensil. The pouring port includes a smaller opening 26 for pouring product from the container. The sift port includes multiple smaller sift holes 28 for sifting product from the container. The three distinct dispensing ports allow the user to select one or more dispensing modes: spoon, pour or sift, depending on the amount and type of product being dispensed. Thus, a wide array of foodstuffs and dispensing applications can be accommodated with this one dispensing top 10.

Dispensing top 10 also comprises an integral cover panel or web 12 shaped to correspond generally to the shape of an open top end of container C, and an annular skirt 14 depending therefrom. Annular skirt 14 may have threads formed on its interior surface for threaded engagement with a container. Alternatively, dispensing top 10 may be attached to container C with adhesive, interference fit, or other suitable attachment methods.

Cover panel 12 has, on its upper surface, a land portion 18 that is surrounded by an annular peripheral shoulder 20. Shoulder 20 includes a surface that is substantially parallel to the upper surface of raised land portion 18. Shoulder 20 enables stacking of multiple container bodies in a stable upright manner when the container bottom has a mating rim that is adapted to sit on the shoulder.

The three dispensing ports are arranged about the periphery of land portion 18. The dispensing ports are disposed on radial axes extending with respect to the center of the cover panel. If desired, the dispensing ports can be located in sequential 120-degree segments around land portion 18. When closed, all of the closures of the dispensing ports are flush with the surface of land portion 18.

The spoon port has a large spoon flap closure 30 integrally joined to land portion 18 by a living hinge 32. Hinge 32 is formed by a thin layer of material extending along the line of the attachment between spoon flap 30 and land portion 18. The spoon flap closure includes a free edge that, along with living hinge 32, defines an outer boundary. A sealing lip 34 extends along the undersurface of spoon flap 30, spaced inwardly from the edge of flap 30 and is configured to fit tightly inside spoon opening 24 and abut against the curved wall of the opening when spoon flap 30 is in the closed position.

The pouring port is provided with a pivotally disposed spout 36 having a cover piece or closure flap 38 integrally joined to land portion 18 by a living hinge 40 Similar to spoon flap hinge 32, pour spout hinge 40 is formed by a thin wall of material extending along the line of attachment between closure flap 38 and land portion 18.

Figure 3:
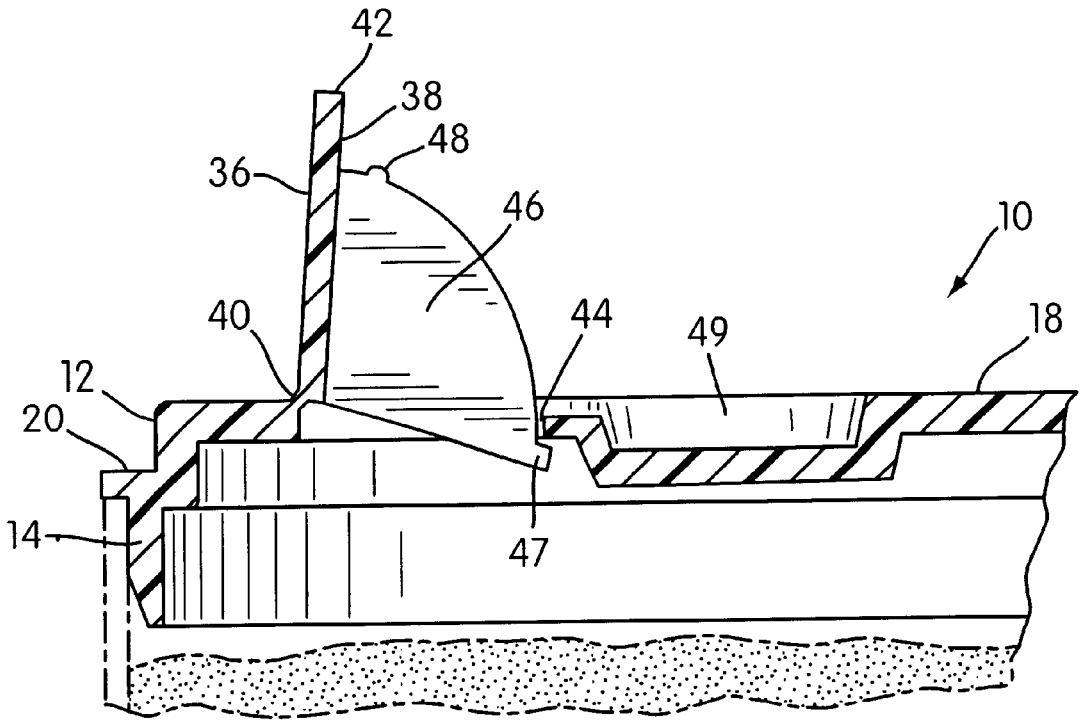
FIG. 3 is partial a cross-sectional view of the tri-closure dispensing top of FIG. 1 showing the pour spout in the open position.
Figure 5:
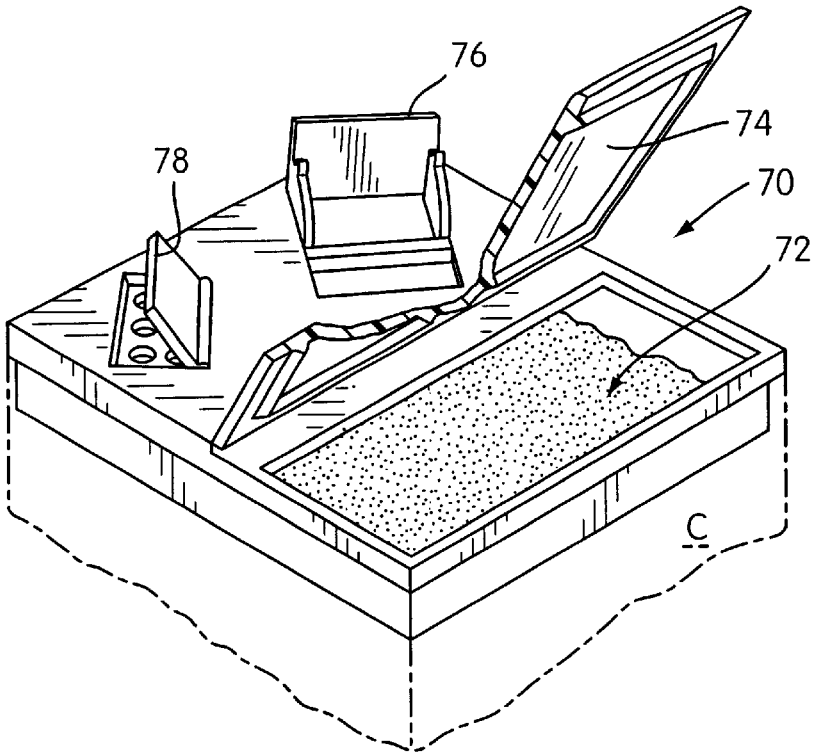
FIG. 5 is a perspective view of a first alternative embodiment of the present invention.

As best shown in FIGS. 3 and 5, the length of pour spout 36 measured from hinge 40 to end 42 of closure flap 38 is slightly greater than the length of pour opening 26. This elongated length of closure 38 is advantageous because when spout 36 is in the closed position the need of the flap closure extends beyond recessed edge 44 of the pour opening thereby completely covering and extending slightly beyond pour opening 26.

Pouring spout 36 also includes a pair of sidewalls 46 that help to guide or funnel product from container C while pouring. Sidewalls 46 extend in parallel from opposing edges of the closure flap 38. Referring to FIG. 3, when pour spout 36 is in a fully opened position, flap closure 38 is substantially 90 degrees with respect to land portion 18. Sidewalls 46 form a substantial quarter circle by extending upwardly from living hinge 40 towards but not all the way to spout end 42 and by extending outwardly from living hinge 40 toward the pour opening recessed edge 44.

When pour spout 36 is pivoted about living hinge 40, sidewalls 46 move in a sweeping motion within pour opening 26 and move relative to land portion 18. This sweeping motion substantially keeps product within pour opening 26 when opening or closing pour spout 36. It should be recognized that the underside surface of flap 38 adjoining the interior surfaces of sidewalls 46 form a pathway, shoot, or an extended pouring surface for the particulate product to exit container C. This advantageously provides the user with the ability to control the direction of the flow of product, instead of pouring product from a mere opening without a guide as in some conventional dispensing tops. In addition, the sidewalls help keep the dispensing top cleaner than those without guides.

As shown in FIG. 3, the sidewalls 46 have bosses 47 extending outwardly from the sidewalls away from living hinge 40 to act as a stop for the movement of pour spout 36. Bosses 47 preferably limit the travel of pour spout 36 to approximately 90 degrees measured relative to land portion 18. Also extending between bosses 47 and sidewalls 46 is a rigid bar. Thus, when sidewalls 46 are squeezed toward one another, the rigid bar provides additional rigidity to keep the sidewalls apart. For example, a person may grasp sidewalls 46 between their index finger and thumb so as to create a squeezing force, the rigid bar prevents the squeezing force from collapsing the sidewalls toward one another and from touching each other. Additionally, when pour spout 36 is substantially opened to a 90 degree angle, the rigid bar engages the under surface of recessed edge 44 to assist bosses 47 in limiting pour spout 36 travel.

Figure 4:
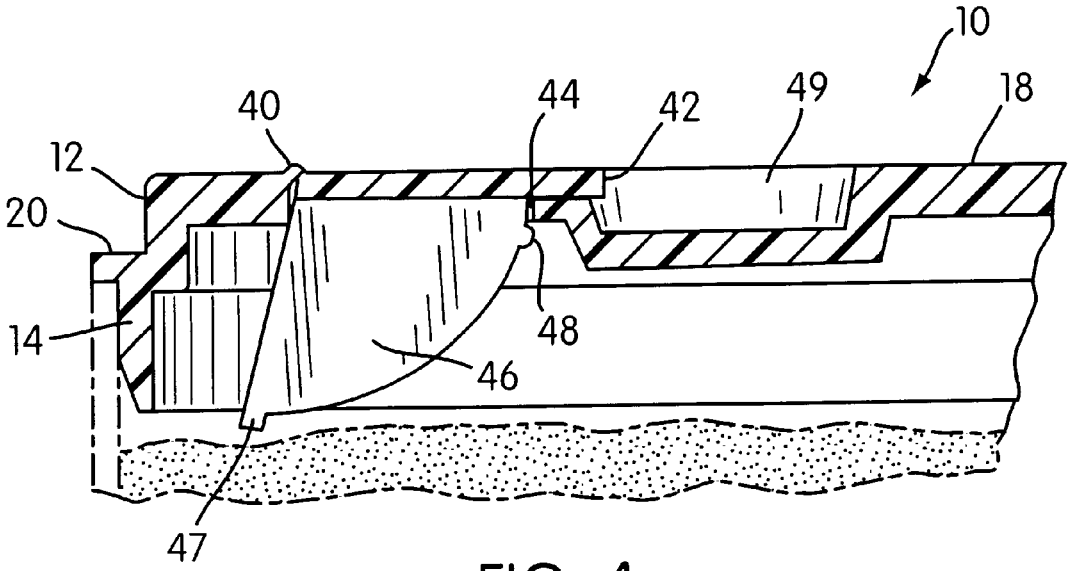
FIG. 4 is a partial cross-sectional view of the tri-closure dispensing top of FIG. 1 showing the pour spout in the closed position.

Pour spout 36 also includes a lock. Detents 48 are located along the periphery of sidewalls 46 near top edge 42 of closure flap 38. Detents 48 engage the underside of recessed edge 44 of pour opening 26. Referring to FIG. 4, the engagement provides for a locking snap fit for sealing opening 26 when pour spout 36 is in a closed position. The resiliency of the plastic material is advantageously employed to provide the snap fit engagement. This lock advantageous reduces the possibility of the spout opening due to pressure extended against it by the particulate or granular product should the container fall or be shaken, particularly during transport operations.

Referring to FIGS. 1–4, dispensing top 10 includes a hemispherical depression portion 49 in land portion 18 for enabling easy lifting of pour spout 36. Depression portion 49 is sufficiently sized to allow a user to place the tip of a finger under top edge 42 of pour spout 36 so as to lift up closure flap 38 prior to pouring product from container C. Depression portion 49 is advantageously located within the interior of land portion 18 near the center of dispensing top 10. The interior location provides for pour spout 36 to be lifted and pivoted towards the direction of annular skirt 14. A substantial portion of the outer periphery 27 of depression portion 49 is preferably shaped in a circular arrangement. If desired, other shapes such as a square or oval, may be used. In the exemplary embodiment, the diameter of depression portion 49 is preferably 0.508 inches, but may range between 0.500 to 0.515 inches in a container top of approximately 3.224 inches diameter. Of course, the proportioned sizes of the depression versus the container top will vary depending on overall size. In general, the depth of depression portion 49 relative to the top surface of land portion 18 is sufficiently sized for a tip of a finger of a user.

The sift port comprises a plurality of relatively smaller sift holes or openings 28 for sifting or shaking granular product from container C. A sift closure flap 52 is integrally joined to land portion 18 by a living hinge 54. The hinge 54 is formed by a thin layer of wall material extending along the line of attachment between the sift flap 52 and the land portion 18. A plurality of plugs 56 extend from the undersurface of sift flap 52 and are sized and shaped to fit snugly inside the corresponding sift holes 28 when sift flap 52 is in the closed position, thereby sealing off the sifting port and locking sift flap 52 in the closed position. Sift openings 28 are arranged in a pattern or an array. In the embodiment shown, the pattern is a four by five array of openings 28. This is preferably a quantity of 20 sift holes 28 in the second port. Plugs 56 are arranged in an array adapted to match the array of the sift holes. One skilled in the art may use any appropriate pattern of sift holes 28 for sifting.

The design of the dispensing ports enables the visually impaired user to readily determine the selected mode of dispensing. The top surface of sift flap 52 includes a tactile feature for a user. The top surface includes a raised texture 59 of the same pattern as sift openings 28 and plugs 56. Raised texture 59 provides a designation to a user that the dispensing port is for sifting or shaking. The tactile feature of raised texture 59 advantageously helps visually impaired users to readily determine the second port. Depression portion 49 additionally indicates that the pour spout or pouring mode is selected for use. Conventional dispensing tops only have letters or symbols that can not be read by the visually impaired, such as a blind user.

Dispensing top 10 also includes small beam members (not shown) on the underside of land portion 18. The beam members provide additional rigidity to land portion 18. The beam members extend the diameter of the land portion 18 and intersect at the center of the land portion 18. In the exemplary embodiment shown, three beam members are employed. The beam members are created during the molding process of dispensing top 10.

All three closure flaps are connected to land portion 18 of dispensing top 10 by living hinges. All three flaps are integrally formed with dispensing top 10 during one molding process. Preferably, each flap is molded in the open position as shown in FIG. 1. Pour spout 36 preferably is molded in the fully upright or open position. Dispensing top 10 is preferably made of a thermoplastic material, such as polyethylene, polypropylene or a polypropylene blend, although other moldable materials may be used.

Container C preferably is cylindrical with a circular or other cross-sectional shape, such as triangular, rectangular, hexagonal, or even irregular. Container C is preferably constructed from wound paper or cardboard and includes a sealed bottom end. The bottom end is preferably made of metal with a rim to match the shape and size of the dispensing top. The bottom end is preferably sized so that its rim can be seated on the shoulder formed on the dispensing top to enable stable vertical stacking.

Pour spout 36, and flaps 30, 52 are designed to be manually opened and closed. To use the dispensing top 10, the user opens one of the closures to expose the desired opening while the other closure remains in the closed position. For example, to pour product from container C, the user raises pour spout 36 to a fully upright position, and tilts container C at the desired angle. The product is then discharged from the interior of container C into spout 36. To seal or close spout 36, the user pushes closure flap 38 downward in a sweeping motion until it completely covers pour opening 26 and detents 48 engage the underside of raised land portion 18. If the user desires to sift product into, say, a bowl, he lifts sift flap 52 from sift openings 28, and gently shakes a desired amount of product into the bowl. When finished, the user simply returns sift flap 52 to the closed position. To spoon product from dispensing top 10, the user lifts spoon flap 30 to expose spoon opening 28. Next the user uses a spoon or other utensil to remove the desired amount of product from container C.

It will be appreciated that the present design maximizes the size of the dispensing openings because no web space need be used to block or cover openings in a second underlying web as in conventional rotating dispensing tops. The dispensing port areas comprise 35% to 70% of the dispensing top surface area, and preferably from 40% to 60%. Thus, the size of the openings may be adjusted in proportion to the overall size of the web.

There is shown in FIG. 5, a first alternative embodiment of the present invention, in which container C has a rectangular cross section and a tri-closure dispensing top 70 is configured accordingly. Dispensing top 70 includes a spoon opening 72, a spoon closure flap 74, a pour spout 76, and a sift flap 78. Dispensing top 70 is similar in structure to dispensing top 10 except for the spoon closure flap 74 and the spoon opening 72. To maximize the size of the spoon opening 72, the spoon opening 72 and the spoon closure flap 74 are also rectangular.

Figure 6:
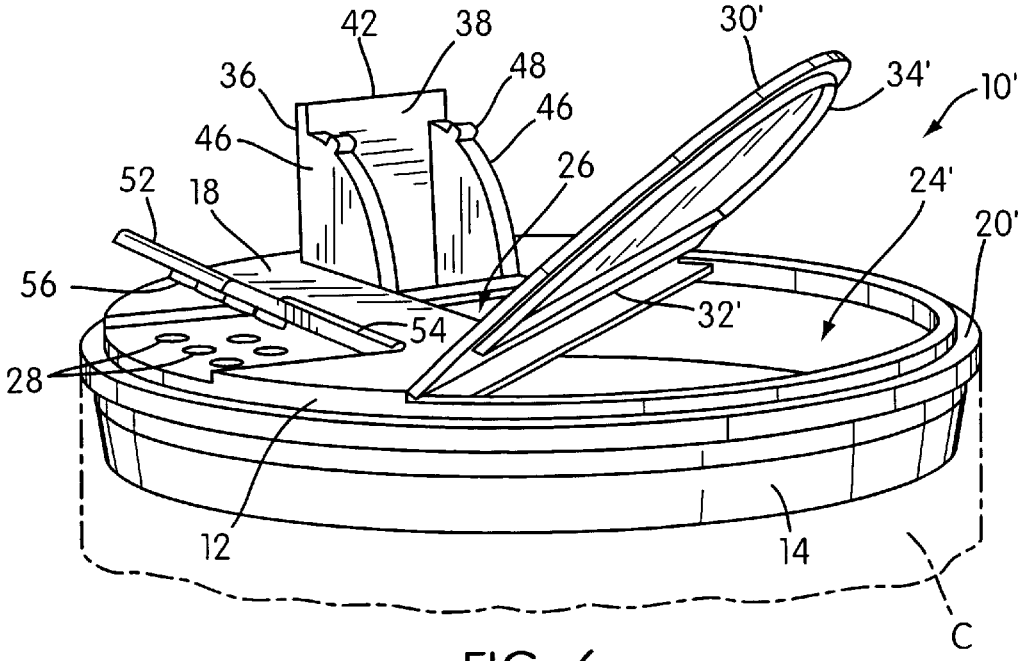
FIG. 6 is a perspective view of a second alternative embodiment of the present invention.

There is shown in FIG. 6, a second alternative embodiment of the present invention, a tri-closure dispensing top 10' configured accordingly. Dispensing top 10' is similar to dispensing top 10, except for the structure of spoon opening 24'. The area defined by spoon opening 24' is at least as half as large as the total web area. Thus, flap 30' and sealing lip 34' is sized accordingly. Living hinge 32' is generally the diameter of dispensing top 10'. The size of the spoon opening 24', however, may be controlled depending on the manufacturing efficiencies employed.

Thus there has been described a single piece dispensing top that can be used for pouring, sifting and spooning product. The dispensing top is easy to manufacture and reduces assembly. The present invention requires less material to manufacture than most conventional dispensing tops, including rotary type tops. The present invention also maximizes the size of the dispensing ports. While these particular embodiments of the invention have been shown and described, it is recognized the various modifications thereof will occur to those skilled in the art. Therefore, the scope of the herein-described invention shall be limited solely by the claims appended hereto.

What is claimed is:

1. A molded top having three openings for dispensing flowable particulate material from a container, the top comprising:

a web, the web being substantially planar;

an annular skirt depending from the web for attachment to the container;

a first opening in the web sized to accommodate an utensil, the first opening having a first closure integrally joined to the web by a first living hinge and configured to seal the first opening;

a second opening in the web having a second closure integrally joined to the web by a second living hinge to pivot between an opened and a closed position and the second closure including a pathway to direct the particulate material in exiting the container in the opened position and configured to seal the second opening when pivoted into the closed position; and a third opening comprising a plurality of smaller sift openings in the web arranged in an array for sifting the particulate material from the container, and a third closure integrally joined to the web by a third living hinge and configured to seal each of the sift openings.

2. The dispensing top of claim 1, wherein the first, second and third closures are opened and closed independently of each other.

3. The dispensing top of claim 2, wherein the first closure includes a free edge that, along with the first living hinge, defines the outer boundary of the first closure, and an undersurface facing the first opening, and wherein the first closure flap has a sealing lip extending along the undersurface and spaced inwardly from the free edge, the sealing lip configured to fit tightly inside the first opening.

4. The dispensing top of claim 3, further comprising a depression portion disposed in the interior of the web partially disposed under the second closure.

5. The dispensing top of claim 4, wherein the second closure comprises an elongated member extending from the second living hinge and configured to overlie and seal the second opening when in the closed position, and a pair of sidewalls extending in parallel from opposing edges of the elongated member, each of the sidewalls having a boss extending from the sidewall in a direction away from the second living hinge to limit how far the elongated member can pivot in the open position, and a detent located along the periphery of the sidewall to provide a snap fit with the web when the second closure is in the closed position.

6. The dispensing top of claim 5, wherein the third closure includes an undersurface facing the third opening, and a plurality of plugs extending from the undersurface and the plugs arranged in an second array matching the array of the small openings, each of the plugs configured to fit tightly inside a corresponding opening.

7. The dispensing top of claim 6, wherein the web is substantially circular.

8. The dispensing top of claim 6, wherein the web is substantially rectangular.

9. The dispensing top of claim 8, wherein the area defined by the first opening is at least half as large as the area defined by the web.

10. The dispensing top of claim 7, wherein the first opening, the second opening, and the sift openings are radially disposed with respect to a center position about the periphery of the web.

11. A three port molded dispensing top, comprising:

a web, the web being substantially planar;

an annular skirt depending from the web for attachment to a container;

a first port having a first opening for spooning a particulate product from the container and a first closure integrally joined to the web by a first living hinge and configured to seal the first opening;

a second port having a second opening and a pivotable extended member for pouring the particulate product from the container, the extended member being integrally joined to the web by a second living hinge, and configured to lock the second opening when pivoted into a closed position;

a third port having a plurality of relatively small openings arranged in an array for sifting the particulate product from the container, and a second closure flap integrally joined to the web by a living hinge and configured to seal the openings; and a depression portion within an interior portion of the web positioned underneath a portion of the extended member.

12. The dispensing top of claim 11, wherein, the extended member includes opposing parallel sidewalls extending therefrom to form a pathway for the particulate product to exit the container.

13. The dispensing top of claim 12, wherein at least one of the sidewalls includes a detent extending therefrom for locking the extended member into the closed position.

14. The dispensing top of claim 13, wherein at least one of the sidewalls includes a boss extending from the sidewalls in a direction away from the second living hinge so as to limit the travel of the extended member.

15. The dispensing top of claim 14, wherein the second closure includes an undersurface having a plurality of plugs extending therefrom and arranged in a second array matching the array of the relatively small openings, and each of the plugs configured to fit tightly inside a corresponding opening.

16. The dispensing top of claim 15, wherein the web includes a shoulder portion disposed around the periphery of the web for stacking a second container thereon.

17. The dispensing top of claim 16, wherein the second closure includes a top surface with a raised texture pattern matching the array for tactile designation.

18. The dispensing top of claim 17, wherein the depression portion includes a retaining area for the extended member.

19. The dispensing top of claim 18, wherein the depression portion is substantially hemispherical.

20. The dispensing top of claim 19, wherein the first opening, the second opening, and the sift openings are disposed about a plurality of radial axes with respect to a center position about the periphery of the web.

* * * * *

UNITED STATES PATENT AND TRADEMARK OFFICE

CERTIFICATE OF CORRECTION

PATENT NO. : 6,341,720 B1
DATED : January 29, 2002
INVENTOR(S) : Michael Schmit et al.

It is certified that error appears in the above-identified patent and that said Letters Patent is hereby corrected as shown below:

Title page,
Item [56], References Cited, insert:
-- OTHER PUBLICATIONS
Two photographs of two closure lid, 1993 --

Signed and Sealed this

Twenty-fifth Day of February, 2003

JAMES E. ROGAN
*Director of the United States Patent and Trademark Office*